US007850820B2

(12) United States Patent
Scherb et al.

(10) Patent No.: US 7,850,820 B2
(45) Date of Patent: Dec. 14, 2010

(54) METHOD FOR THE PRODUCTION OF TISSUE PAPER

(75) Inventors: Thomas Scherb, Sao Paulo (BR); Ronaldo Parucker, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 525 days.

(21) Appl. No.: 11/506,036

(22) Filed: Aug. 17, 2006

(65) Prior Publication Data

US 2007/0062657 A1 Mar. 22, 2007

(30) Foreign Application Priority Data

Aug. 18, 2005 (DE) ..... 10 2005 039 015

(51) Int. Cl.
*D21F 11/00* (2006.01)
*D21F 11/14* (2006.01)
*D21F 3/02* (2006.01)

(52) U.S. Cl. ..... 162/117; 162/204; 162/205; 162/206; 34/400

(58) Field of Classification Search ..... 162/109, 162/117, 202–207, 358.3; 34/114–116, 122–123, 34/397–400
See application file for complete search history.

(56) References Cited

U.S. PATENT DOCUMENTS 3,301,746 A * 1/1967 Sisson et al. ..... 162/113
5,851,353 A * 12/1998 Fiscus et al. ..... 162/113
6,077,398 A * 6/2000 Fiscus et al. ..... 162/361
6,103,062 A * 8/2000 Ampulski et al. ..... 162/109
6,998,017 B2 * 2/2006 Lindsay et al. ..... 162/109
7,150,110 B2 * 12/2006 Herman et al. ..... 34/399
7,291,249 B2 * 11/2007 Thoroe-Scherb et al. . 162/358.1
7,294,237 B2 * 11/2007 Herman et al. ..... 162/358.3
7,297,233 B2 * 11/2007 Herman et al. ..... 162/358.1
7,351,307 B2 * 4/2008 Scherb et al. ..... 162/115
7,387,706 B2 * 6/2008 Herman et al. ..... 162/203
7,428,786 B2 * 9/2008 Herman et al. ..... 34/399
7,476,293 B2 * 1/2009 Herman et al. ..... 162/206
7,476,294 B2 * 1/2009 Herman et al. ..... 162/206
7,510,631 B2 * 3/2009 Scherb et al. ..... 162/358.1
7,527,709 B2 * 5/2009 Lippi Alves Fernandes et al. ..... 162/358.4
7,582,187 B2 * 9/2009 Scherb et al. ..... 162/112
7,585,395 B2 * 9/2009 Quigley et al. ..... 162/358.4
7,591,925 B2 * 9/2009 Scherb et al. ..... 162/111

(Continued)

FOREIGN PATENT DOCUMENTS

DE 101 34 906 7/2001

(Continued)

OTHER PUBLICATIONS

MNachine translation of WO 2003/008706 A1, published on Jan. 1, 2003.*

*Primary Examiner*—José A Fortuna
(74) *Attorney, Agent, or Firm*—Taylor IP

(57) ABSTRACT

This invention relates to a method for the production of a three-dimensionally structured tissue paper web with which the tissue paper web is pressed, in order for it to be structured, on a three-dimensionally structured mesh and with which the tissue paper web is conveyed, unheld by a skin, in a drying step over a heated surface. The tissue paper web is conveyed, held only by the structured mesh, in another drying step prior to the drying step over at least one heated surface.

57 Claims, 6 Drawing Sheets

U.S. PATENT DOCUMENTS

| | | | | |
|---|---|---|---|---|
| 7,597,778 | B2 * | 10/2009 | Thoroee Scherb | 162/123 |
| 2002/0060046 | A1 * | 5/2002 | Scherb et al. | 162/358.1 |
| 2003/0056911 | A1 * | 3/2003 | Hermans et al. | 162/101 |
| 2004/0020614 | A1 * | 2/2004 | Lindsay et al. | 162/109 |
| 2004/0237210 | A1 * | 12/2004 | Thoroe-Scherb et al. | 8/115.51 |
| 2005/0126031 | A1 * | 6/2005 | Herman et al. | 34/114 |
| 2005/0167061 | A1 | 8/2005 | Scherb et al. | 162/115 |
| 2005/0167062 | A1 * | 8/2005 | Herman et al. | 162/115 |
| 2005/0167066 | A1 * | 8/2005 | Herman et al. | 162/203 |
| 2005/0167068 | A1 * | 8/2005 | Herman et al. | 162/358.1 |
| 2006/0085998 | A1 * | 4/2006 | Herman et al. | 34/453 |
| 2006/0085999 | A1 * | 4/2006 | Scherb et al. | 34/453 |
| 2006/0086473 | A1 * | 4/2006 | Herman et al. | 162/358.2 |
| 2006/0225300 | A1 * | 10/2006 | Herman et al. | 34/114 |
| 2006/0237154 | A1 * | 10/2006 | Edwards et al. | 162/111 |
| 2007/0029061 | A1 * | 2/2007 | Scherb et al. | 162/289 |
| 2007/0062657 | A1 * | 3/2007 | Scherb et al. | 162/117 |
| 2007/0272385 | A1 * | 11/2007 | Quigley et al. | 162/267 |
| 2008/0023165 | A1 * | 1/2008 | Herman et al. | 162/205 |
| 2008/0128104 | A1 * | 6/2008 | Scherb et al. | 162/358.2 |
| 2008/0149292 | A1 * | 6/2008 | Scherb | 162/309 |
| 2008/0196855 | A1 * | 8/2008 | Herman et al. | 162/205 |
| 2008/0210397 | A1 * | 9/2008 | Scherb et al. | 162/205 |
| 2008/0251227 | A1 * | 10/2008 | Scherb et al. | 162/357 |
| 2008/0257513 | A1 * | 10/2008 | Scherb et al. | 162/281 |
| 2008/0257514 | A1 * | 10/2008 | Scherb et al. | 162/281 |
| 2009/0165979 | A1 * | 7/2009 | Scherb et al. | 162/210 |
| 2009/0165980 | A1 * | 7/2009 | Scherb et al. | 162/210 |
| 2009/0183847 | A1 * | 7/2009 | Thoroe Scherb et al. | 162/111 |
| 2009/0205797 | A1 * | 8/2009 | Fernandes et al. | 162/203 |
| 2009/0242158 | A1 * | 10/2009 | Scherb et al. | 162/283 |

FOREIGN PATENT DOCUMENTS

| | | | |
|---|---|---|---|
| DE | 10134906 | A1 * | 2/2003 |
| EP | 1626121 | A1 * | 2/2006 |
| EP | 1754824 | A1 * | 2/2007 |
| EP | 1837439 | A2 * | 9/2007 |
| EP | 1845187 | A2 * | 10/2007 |
| JP | 2008190114 | A * | 8/2008 |
| WO | WO 03000002 | A1 * | 1/2003 |
| WO | WO 03008706 | A1 * | 1/2003 |
| WO | WO 03/062528 | | 7/2003 |
| WO | PCT/EP2005/050198 | | 8/2005 |
| WO | PCT/EP2005/050203 | | 8/2005 |
| WO | WO 2005075732 | A2 * | 8/2005 |
| WO | WO 2007057322 | A2 * | 5/2007 |
| WO | WO 2007068539 | A1 * | 6/2007 |
| WO | WO 2007068540 | A1 * | 6/2007 |

* cited by examiner

PRIOR ART

PRIOR ART

METHOD FOR THE PRODUCTION OF TISSUE PAPER

BACKGROUND OF THE INVENTION

1. Field of the Invention

The invention relates to a method for the production of a three-dimensionally structured tissue paper.

2. Description of the Related Art

Tissue paper ideally displays a high absorbency and a high water absorption capacity coupled with a high tear resistance. The absorbency and water absorption capacity are defined essentially by the volume and porosity of the tissue paper. To increase the volume it was already proposed in the prior art in WO03/062528 to press the tissue paper web during production only on a zone basis in order to obtain only slightly pressed or unpressed voluminous regions and pressed regions of greater tear resistance.

During the production of tissue paper the latter is conveyed in a final drying step over the circumferential surface of a heated Yankee drying cylinder before the finished product is crêped by said cylinder. During the conveyance of the tissue paper web over the Yankee drying cylinder the tissue paper web is held by a skin.

In particular, during the production of tissue paper with voluminous areas, which are only slightly compressed during the dewatering, there is a problem in that the tissue paper has too small a dry content when brought into contact with the hot circumferential surface of the Yankee drying cylinder. This problem becomes greater on fast running machines because on such machines the dewatering times are reduced further and therefore the voluminous areas carry even more moisture.

When the tissue paper web makes contact with the heated circumferential surface of the Yankee drying cylinder, the excessively small dry content results in steam forming between the hot circumferential surface and the tissue paper web, which can lead to the web lifting off the circumferential surface.

The consequences of the tissue paper web lifting off the circumferential surface can range from runnability problems to tearing of the tissue paper web.

Furthermore, the formation of steam between the tissue paper web and the heated circumferential surface of the Yankee drying cylinder can give rise to the formation of bubbles and holes in the tissue paper web.

SUMMARY OF THE INVENTION

The present invention is directed to a cost-effective method for the production of a tissue paper web, with which it is possible to produce tear-resistant tissue paper with a high water absorption capacity and absorbency at a high level of productivity.

The invention is accomplished by a method for the production of a three-dimensionally structured tissue paper web having the steps of pressing the tissue, in order for it to be structured, on a three-dimensionally structured mesh, conveying said tissue paper web, held only by the structured mesh, in a first drying step and then conveying the tissue paper web, unheld by a skin, in a second drying step over at least one heated surface.

In the case of the known method for the production of a three-dimensionally structured tissue paper web, the latter is pressed, in order for it to be structured, on a three-dimensionally structured mesh. Also, with the known method the tissue paper web is conveyed, unheld by a skin, in a drying step over a heated surface.

In the case of the method according to the invention provision is made in addition for the tissue paper web to be conveyed, held only by the structured mesh, in another drying step prior to the drying step over at least one heated surface.

In this case the permeable skin holds the tissue paper web in that the tissue paper web is conveyed between the skin and the heated surface.

In the second drying step the tissue paper web is dried by means of contact drying on the heated surface. Water contained in the tissue paper web evaporates and escapes through the permeable skin. Furthermore, the tissue paper web is held by the permeable skin on the heated surface and therefore is unable to lift off during this drying step. In this case the other drying step is constructed such that enough moisture is drawn from the tissue paper web for the tissue paper web to have a dry content that suffices during the subsequent drying step, in which the tissue paper web is conveyed unheld over a heated surface, for it not to lift off said surface due to the generation of steam.

As the result of the other drying step being performed essentially by means of only a heated surface and a permeable skin, a cost-effective method is proposed for enabling the dry content of the tissue paper web to be accordingly adjusted prior to contact with, for example, the Yankee drying cylinder such that the web does not lift off the Yankee drying cylinder.

Through the high dry content of the tissue paper web after the other drying step it is also possible to reduce the drying performance of the Yankee drying cylinder for achieving the same dry content after the crêping operation, thereby saving investment costs and operating costs.

It is even conceivable for the method to totally dispense with the Yankee drying cylinder, meaning the heated surface over which the tissue paper web is conveyed unheld by a skin, and for the drying of the tissue paper web to be performed entirely through contact drying by means of conventional drying cylinders, meaning on a heated surface over which the tissue paper web, held by a permeable skin, is conveyed. This is possible not least because crêping on the Yankee drying cylinder can be dispensed with as the result of the voluminous structure of the tissue paper web already existing in some areas.

As already explained, the heated surface in the drying step is formed preferably by the circumferential surface of a Yankee drying cylinder.

To increase the contact area and hence the drying capacity in the other drying step provision is made for the heated surface in the other drying step to be formed by the circumferential surface of a conventional drying cylinder which is enwrapped for the bigger part by the permeable skin.

The conventional drying cylinder is preferably one with a diameter of 2 meters or less. Consequently, the investment costs for providing the other drying step are greatly lowered.

As steam is produced at many points of the paper production process it is particularly cost-effective for the drying cylinder to be heated by steam.

In order, on the one hand, to be able to individually adjust the dry content in the other drying step and on the other hand to be able to achieve a higher dry content after the other drying step, it makes sense to arrange, in the wrap zone above the drying cylinder, a steam blower box from which steam is directed through the permeable skin onto the tissue paper web.

In the other drying step, provision is made preferably for several heated surfaces, each formed by the circumferential surface of a drying cylinder which is enwrapped for the bigger part by the permeable skin.

With the method, some areas of the tissue paper web are preferably more intensively compressed than other areas of the tissue paper web. This is possible, for example, if the tissue paper web is formed already from the pulp suspension on a three-dimensionally structured mesh. Here the tissue paper web has voluminous pillow areas formed in the depressed regions of the structured mesh and less voluminous areas formed in the raised regions of the mesh in between. Furthermore, the voluminous areas of the tissue paper web formed in the depressed regions of the structured mesh have a higher gsm (grams per square meter) substance than the less voluminous areas lying in between.

After the other drying step the tissue paper web has a dry content of 34% or more, preferably 38% or more.

The structured mesh can be a TAD (Through Air Dried) mesh.

With regard to the structure of the structured mesh and with regard to the formation of the tissue paper web on the structured mesh, reference is made to PCT/EP2005/050203, which herewith is included in full in this application.

After the formation of the tissue paper web, the tissue paper web is conveyed preferably in a dewatering step between an upper structured, in particular 3-dimensionally structured, and permeable skin and a lower permeable skin, whereby pressure is exerted on the upper skin, the tissue paper web and the lower skin during the dewatering step along a dewatering section. As the result, the tissue paper web is dewatered in the direction of the lower skin and through the lower skin.

The pressure exerted here on the arrangement of an upper structured and permeable skin, tissue paper web and lower permeable skin can be generated by a gas flow. In addition or alternatively to this, the pressure exerted can be generated by a mechanical pressing force.

To compress the tissue paper web only in some regions by the application of pressure and thus produce a tissue paper with a high volume for good absorbency in some regions—in the unpressed or less pressed regions—and with high strength in other regions—in the more intensively pressed regions—it makes sense for the side of the structured skin facing the tissue paper web to comprise depressed regions and raised regions relative to the depressed regions. Consequently, as previously mentioned, the tissue paper web is compressed less intensively in the depressed regions than in the raised regions.

The upper structured and permeable skin is preferably a 3-dimensionally structured mesh, in particular a TAD mesh, and the lower permeable skin is preferably a press felt having a sufficiently high water absorption capacity for the water which is pressed out of the tissue paper web. With regard to the structure of the lower skin, reference is made to PCT/EP2005/050198, which herewith is included in full in this application.

By using a press felt as the lower skin, the dewatering through the lower skin can be performed in a far more effective and energy-saving manner than compared with the possible use of a TAD mesh as the lower skin. Tests in this connection conducted by the claimant indicate that the vacuum power can be reduced by a factor of 2 when using a press felt rather than a TAD mesh as the lower skin.

To ensure that the voluminous areas of the tissue paper are only slightly pressed during the dewatering step it makes sense for the structured mesh in the dewatering step to be the same mesh as in the formation of the tissue paper web. As the result, the voluminous pillow areas of the tissue paper web remain, during application of the pressure, in the same depressed regions of the structured mesh in which they were formed such that the voluminous areas are largely protected against the application of pressure and far less pressure is exerted on these areas than on the areas of the tissue paper web lying in between. The voluminous structure of the pillow areas is thus retained during the dewatering step.

To ensure that the voluminous structure of the pillow areas of the tissue paper are retained also during the other drying step it makes sense for the structured mesh in the dewatering step to be the same mesh as that in the other drying step. Hence there is no need to transfer the tissue paper web during the dewatering step from the structured mesh onto the structured mesh for the other drying step, as the result of which the voluminous pillow areas of the tissue paper web are protected by the same depressed regions of the structured mesh during the other drying step and during the dewatering step.

The compressibility (change of thickness in mm upon application of force in N) of the upper skin is preferably smaller than the compressibility of the lower skin. The voluminous structure of the tissue paper web upon the application of pressure is thus retained.

Tests have shown that a particularly good and gentle dewatering is possible when the dynamic rigidity (K)—as a measure for the compressibility of the upper skin—is 3000N/mm or more.

Given a hard or excessively hard lower skin, the voluminous pillow areas of the tissue paper web would not be compressed at all. Thanks to the compressible structure of the lower skin the voluminous pillow areas of the tissue paper are slightly pressed and hence gently dewatered. Tests in this connection have shown that the dynamic rigidity (K)—as a measure for the compressibility of the lower skin—is 100000N/mm or less, preferably 90000N/mm, in particular preferably 70000N/mm or less.

Similarly it is an advantage for the G modulus—as a measure for the elasticity of the lower skin—to be $2N/mm^2$ or more, preferably $4N/mm^2$ or more.

Also, tests have shown that the water stored in the lower skin, for example the press felt, can be expelled more easily with a gas flow when the permeability of the lower skin is not too high. It proves to be an advantage when the permeability of the lower skin is 80 cfm (cubic feet per minute) or less, preferably 40 cfm or less, in particular preferably 25 cfm or less. In the above mentioned regions the rewetting of the tissue paper web by the lower skin is largely prevented.

In the dewatering step, preferably the upper skin is first charged with gas, then the tissue paper web and finally the lower skin. The dewatering of the paper web takes place in this case in the direction of the lower skin.

Optionally or in addition to gas charging of the above mentioned arrangement provision can be made for the arrangement of upper skin, tissue paper web and lower skin to be conveyed during the dewatering step at least in some areas along the dewatering section between a tensioned press belt and a smooth surface, whereby the press belt acts on the upper skin and the lower skin rests on the smooth surface. In this case, too, the dewatering of the paper web takes place in the direction of the lower skin.

The arrangement of upper skin, tissue paper web and lower skin is preferably charged with the gas flow at least in some areas in the region of the dewatering section so that the dewatering takes place simultaneously by the pressing force of the press belt and the through-flow of gas.

Tests have shown that the gas flow through the tissue paper web amounts to approx. 150 $m^3$ per minute per meter length along the dewatering section.

Here the gas flow can be generated by a suction zone in a roller. In this case the suction zone has a length in the range between 200 mm and 2500 mm, preferably between 800 mm and 1800 mm, in particular preferably between 1200 mm and 1600 mm, and the vacuum in the suction zone amounts to between −0.2 bar and −0.8 bar, preferably between −0.4 bar and −0.6 bar.

Optionally or in addition to this, the gas flow can also be generated by an excess pressure hood arranged above the top skin.

In the latter case the temperature of the gas flow amounts to between 50° C. and 180° C., preferably between 120° C. and 150° C., and the excess pressure amounts to less than 0.2 bar, preferably less than 0.1 bar and in particular preferably less than 0.05 bar. The gas can be hot air or steam.

The pressing force can be increased by a high tension of the press belt. Tests have shown that sufficient dewatering particularly of the non-voluminous areas of the tissue paper is obtained when the press belt is under a tension of at least 30 kN/m, preferably at least 60 kN/m or 80 kN/m.

To be able to obtain a good dewatering of the tissue paper web by the mechanical tensioning of the press belt and as the result of the gas flow through the press belt it makes sense for the press belt to have an open area of at least 25% and a contact area of at least 10% of its total area facing the upper skin.

A uniform mechanical pressure is exerted on the arrangement of structured upper skin and lower skin by increasing the contact area of the press belt.

Satisfactory results are obtained with all the values stipulated below for the contact area and open area of the press belt.

Provision is made accordingly for the press belt to have an open area of between 75% and 85% and a contact area of between 15% and 25% of its total area facing the upper skin.

Also, provision is made for the press belt to have an open area of between 68% and 76% and a contact area of between 24% and 32% of its total area facing the upper skin.

The very good results with regard to dry content and voluminosity of the tissue paper are obtained when the press belt has an open area of between 51% and 62% and a contact area of between 38% and 49% of its total area facing the upper skin.

The above mentioned press belts can be press belts with a spiralized structure for example.

Very good results with regard to dry content and voluminosity of the tissue paper are also obtained when the press belt has an open area of between 50% or more and a contact area of between 50% or more of its total area facing the upper skin. Such a press belt is formed by a woven structure for example.

The smooth surface is formed preferably by the circumferential surface of a roller.

Through the above described dewatering operation it is possible for the tissue paper web to leave the dewatering section with a dry content of approximately 30%.

After the dewatering step the tissue paper web is preferably conveyed together with the structured skin of the dewatering step through a press nip in a further dewatering step and dewatered further.

Furthermore, the tissue paper web in the press nip is preferably arranged between the structured and permeable upper skin and an in particular smooth and heated roller surface, in which case the heated and smooth surface is formed preferably by the circumferential surface of a Yankee drying cylinder.

Transferring the tissue paper web on the structured upper skin through the press nip ensures that, during this dewatering step as well, the voluminous pillow areas of the tissue paper are less intensively pressed than the areas lying in between.

The depressed and by comparison relatively raised areas of the structured and permeable skin are constructed and arranged in relation to each other such that only 35% or less, in particular only 25% or less of the tissue paper web is pressed in the press nip.

If, as previously mentioned, the structured upper skin is the same structured skin as that on which the tissue paper was formed, then the 3-dimensional structure of the tissue paper is created already during the formation. By contrast, with the method according to the prior art the 3-dimensional structure of the tissue paper is not formed until during a subsequent dewatering step by the tissue paper web being pressed into a structured mesh, thus forming an essentially two-sided corrugated tissue paper.

With the method according to the invention, the formation of the tissue paper between the structured skin and a forming mesh with a relatively smooth surface forms a tissue paper web which is essentially smooth on the side which was formed on the smooth forming mesh. While passing through the press nip and after passing through the press nip this side comes into contact with the circumferential surface of the Yankee drying cylinder, in which case burning of the tissue paper web at high temperatures of the circumferential surface of the Yankee drying cylinder is prevented as the result of the relatively large contact area (the latter amounts during formation of the tissue paper web between the three-dimensionally structured mesh and the forming mesh and during its subsequent dewatering between the three-dimensionally structured mesh and the press felt to 90% or more, depending on the process conditions often nearly 100%, of the total area of this side compared to only around 25% of this side in the prior art). As the result, the temperature of the Yankee drying cylinder can be raised compared to the prior art, leading to a higher dry content of the tissue paper web produced.

In the interest of gentle pressing in the press nip it is preferable for the press nip to be a shoe press nip.

To remove water, which is carried in the structured upper skin and which obstructs dewatering in the press nip, it is preferable for the tissue paper web to be conveyed together with the structured skin around an evacuated deflector roller, whereby the structured skin is arranged between the tissue paper web and the evacuated deflector roller.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
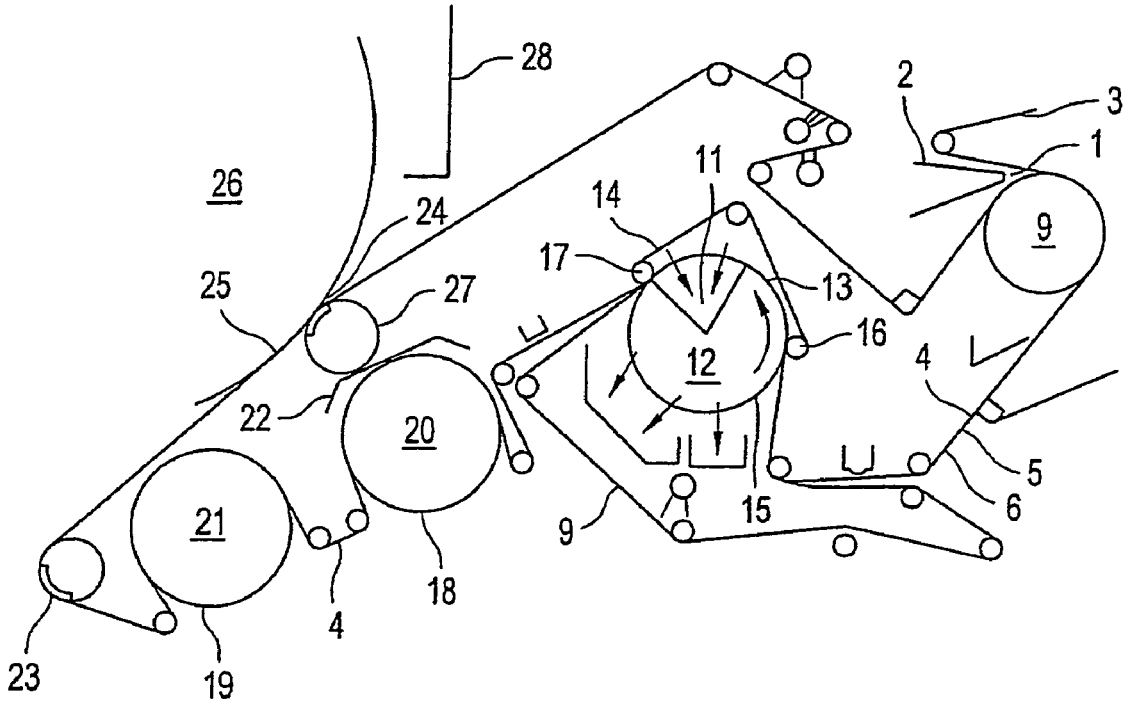
FIG. 1 shows a first apparatus for performing the method according to the invention.
Figure 2:
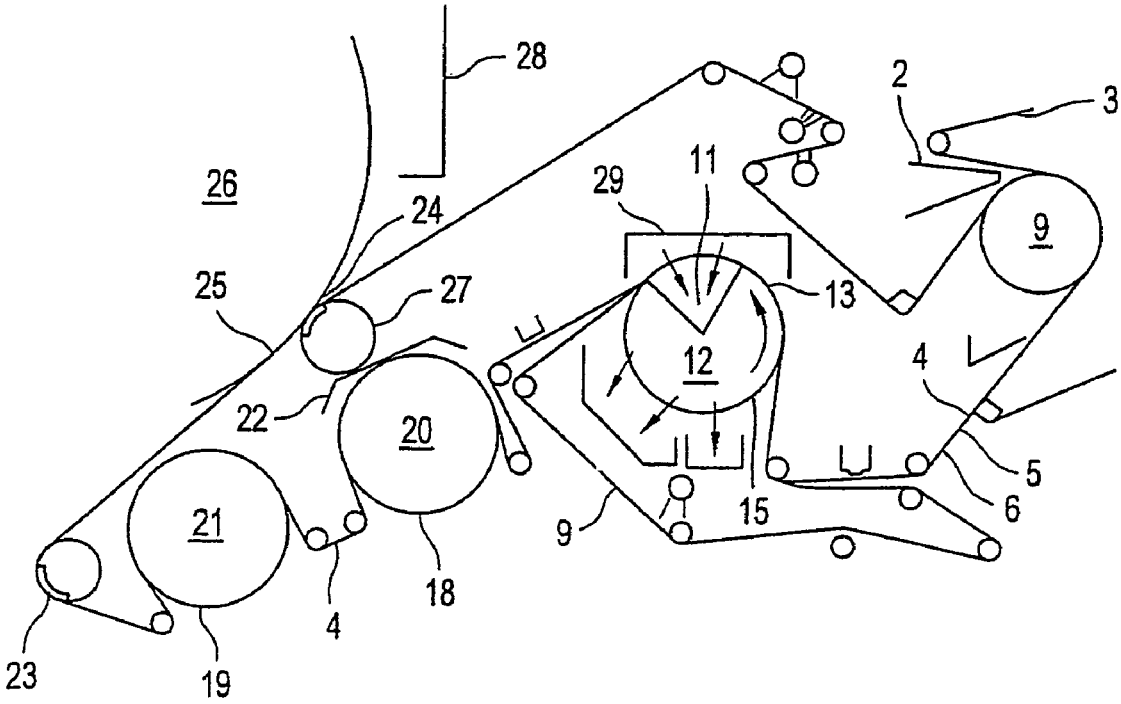
FIG. 2 shows a second apparatus for performing the method according to the invention.
Figure 3:
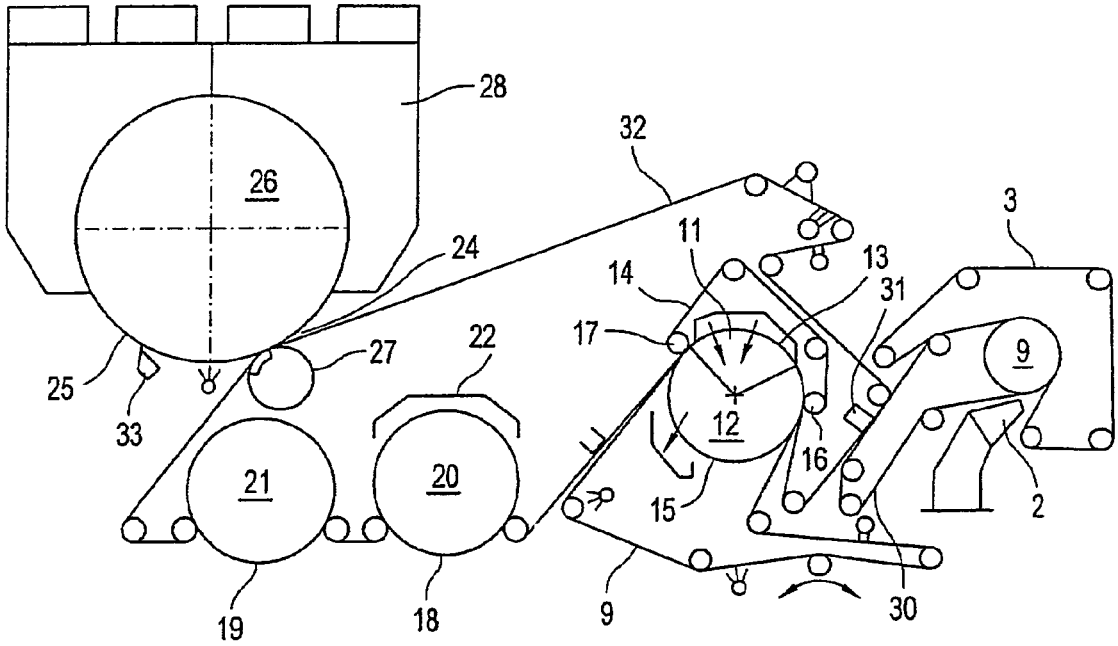
FIG. 3 shows a third apparatus for performing the method according to the invention.

The procedure will now be explained with reference to the FIGS. 1 and 4 to 12 using an embodiment of the procedure according to the invention which can be performed with the apparatus in FIG. 1. FIGS. 1, 2 and 3 show embodiments of different apparatuses for performing the method according to the invention.

A pulp suspension 1 emerges from a headbox 2 such that said suspension is injected into the ingoing nip between a forming mesh 3 and a structured, in particular 3-dimensionally structured mesh 4, as the result of which a tissue paper web 5 is formed.

The forming mesh 3 has a side facing the tissue paper web 5, which is relatively smooth compared to that of the structured mesh 4.

Here the side 6 of the structured mesh 4 facing the tissue paper web 5 has depressed regions 7 and, relative to the depressed areas 7, raised regions 8 such that the tissue paper web 5 is formed in the depressed regions 7 and the raised regions 8 of the structured mesh 4. The difference in height between the depressed regions 7 and the raised regions 8 amounts to preferably 0.07 mm and 0.6 mm. The area formed by the raised regions 7 amounts to preferably 10% or more, in particular preferably 20% or more and in particular preferably 25% to 30%. In the embodiment presented in FIG. 3 the structured mesh 4 is shown as a TAD mesh 4.

Figure 4:
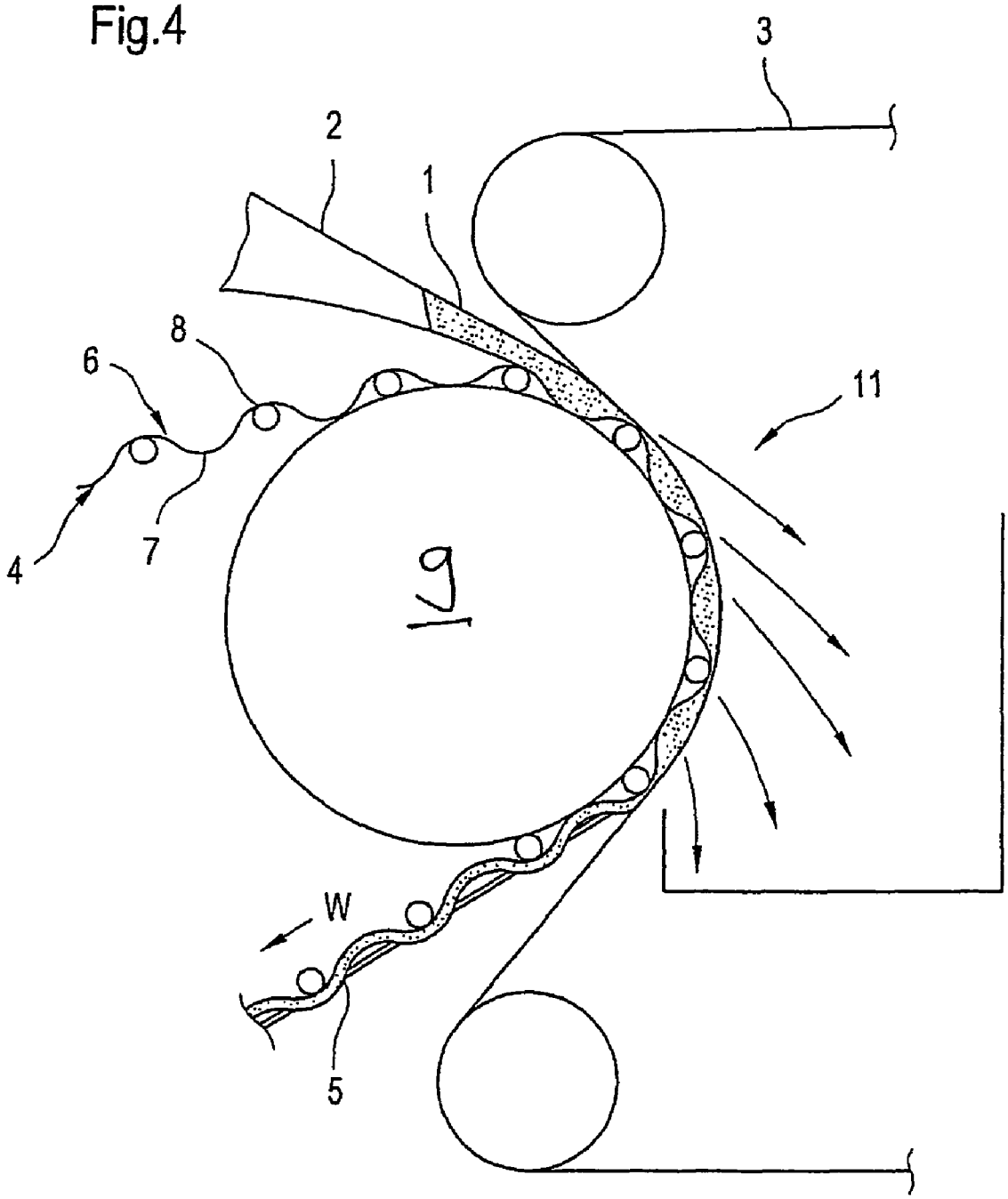
FIG. 4 shows a partial representation of the apparatus for performing the method according to the invention for the production of tissue paper according to FIG. 1 or FIG. 2.

In the embodiment presented in FIG. 4 the arrangement of TAD mesh 4, tissue paper web 5 and forming mesh 3 is directed around a forming roller 9 and the tissue paper web 5 is dewatered essentially by the forming mesh 3 before the forming mesh 3 is taken off the tissue paper web 5 and the tissue paper web 5 is transported further on the TAD mesh 4.

Figure 5:
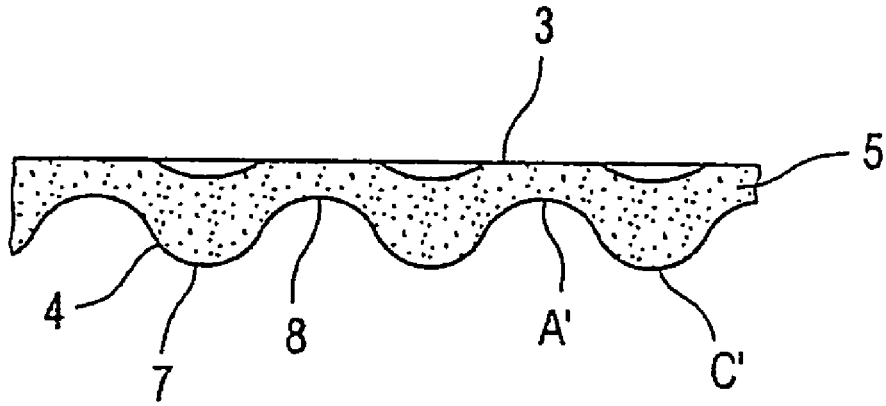
FIG. 5 shows the structure of a tissue paper web upon its formation with the method according to the invention performed with the apparatus in FIG. 1.

Evident in FIG. 5 is the structure of the tissue paper web 5 formed between the flat forming mesh 3 and the TAD mesh 4. The voluminous pillow areas C' of the tissue paper web 5 formed in the depressed regions 7 of the TAD mesh 4 have a higher volume and a higher gsm substance than the areas A' of the tissue paper web 5 formed in the raised regions 8 of the TAD mesh 4.

Accordingly, the tissue paper web 5 already has a 3-dimensional structure as the result of its forming on the structured mesh 4.

Figure 6:
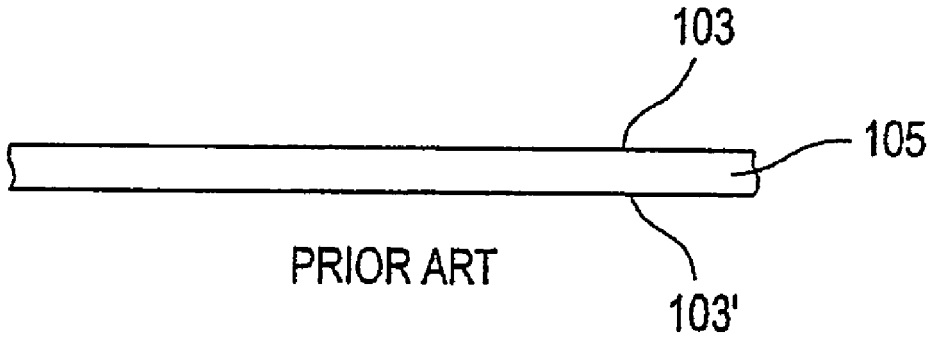
FIG. 6 shows the structure of a tissue paper web upon its formation with a known method according to the prior art.

Evident in FIG. 6 is a tissue paper web 105 which was formed between two flat forming meshes 103 and 103'.

As the result of its forming between two smooth forming meshes 103 and 103', the tissue paper web 105 has an essentially smooth and non-3-dimensional structure.

Figure 7:
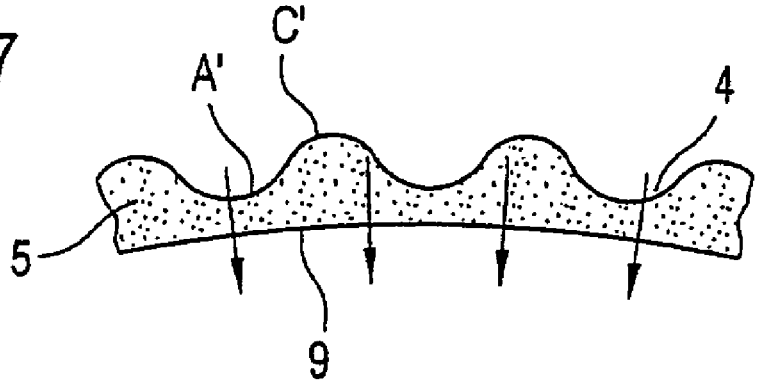
FIG. 7 shows the structure of a tissue paper web upon its dewatering with the method according to the invention performed with the apparatus in FIG. 1.

In a dewatering step after the formation of the tissue web 5 the tissue paper web 5 is conveyed between the structured mesh 4, which is arranged above, and a lower permeable skin 9, which is constructed as press felt 9, whereby during the dewatering step along a dewatering section pressure is exerted on the structured mesh 4, the tissue paper web 5 and the press felt 9 such that the tissue paper web 5 is dewatered in the direction of the press felt 9, as indicated by the arrows 10 in the FIG. 7. Through the dewatering of the tissue paper web 5 in the direction of the flat or smooth press felt 9, the fibers are pressed in the direction of the flat press felt 9, as the result which the side of the tissue paper web adjacent the press felt 9 becomes even flatter.

As the result of the tissue paper web 5 being dewatered during this dewatering step in the direction of the press felt 9 and as the result of the tissue paper web 5 being dewatered on the structured mesh 4 on which it was previously formed, the voluminous areas C' are less intensively compressed than the areas A', thus resulting in the voluminous structure of the areas C' being preserved.

Figure 8:
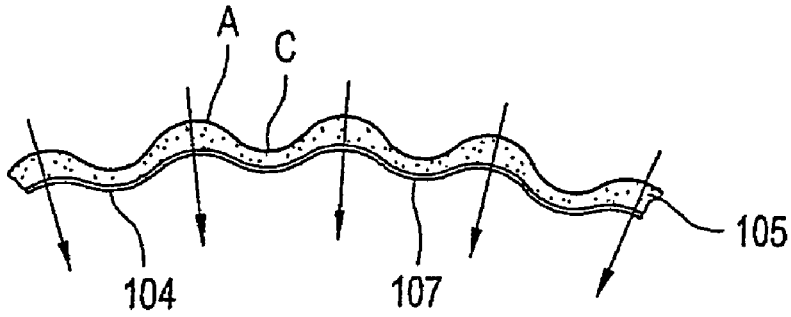
FIG. 8 shows the structure of a tissue paper web upon its 3-dimensional structuring with a known method according to the prior art.

Evident in FIG. 8 is the creation of a 3-dimensional structure of the tissue paper web 105 formed in FIG. 6. To create the 3-dimensional structure, the tissue paper web 105 must be pressed into a structured mesh 104. For this purpose the tissue paper web 105 in the areas C, which are pressed into the depressed regions 107 of the structured mesh 104, are stretched, as the result of which the gsm substance in the areas C is reduced. Also, the tissue paper web 105 in the areas C is intensively pressed, as the result of which the volume of the areas C is reduced as well.

The pressure for dewatering the tissue paper web 5 is generated during the dewatering step at least in some areas simultaneously by a gas flow and a mechanical pressing force.

Here the gas flow passes first through the structured mesh 4, then the tissue paper web 5 and finally the lower skin constructed as press felt 9. The gas flow through the tissue paper web 5 amounts to around 150 m3 per minute and meter web length.

In the case under consideration the gas flow is generated by a suction zone 11 in a roller 12, the suction zone 11 having a length in the region of between 200 mm and 2500 mm, preferably between 800 mm and 1800 mm, in particular preferably between 1200 mm and 1600 mm.

The vacuum in the suction zone 11 amounts to between −0.2 bar and −0.8 bar, preferably between −0.4 bar and −0.6 bar.

With regard to performing the dewatering step by mechanical pressing force and, optionally or in addition to this, with a gas flow, and with regard to the various configurations of apparatus for performing such a dewatering step, PCT/EP2005/050198 shall be included in full in the disclosure content of this current application.

The mechanical pressing force is generated during the dewatering step by conveying the arrangement of structured mesh 4, tissue paper web 5 and press felt 9 to a dewatering section 13 between a tensioned press belt 14 and a smooth surface 15, in which case the press belt 14 acts on the structured mesh 4 and the press felt 9 rests on the smooth surface 15.

The smooth surface 15 is thus formed by the circumferential surface 15 of the roller 12. The dewatering section 13 is defined essentially by the wrap zone of the press belt 14 around the circumferential surface 15 of the roller 12, whereby the wrap zone is defined by the distance between the two deflector rollers 16 and 17.

The press belt 14 is under a tension of at least 30 kN/m, preferably at least 60 kN/m or 80 kN/m, and has an open area of at least 25% and a contact area of at least 10% of its total area facing the upper skin.

In this specific case the press belt 14 is constructed as a spiral link fabric and has an open area of between 51% and 62% and a contact area of between 38% and 49% of its total area facing the upper skin.

With regard to the structure of the press belt, PCT/EP2005/050198 shall be included in full in the disclosure content of this present application.

The tissue paper web 5 leaves the dewatering section 13 with a dry content of around 30%.

After the dewatering step the tissue paper web 5 is subjected to a drying step during which said web, held by the structured mesh 4, is conveyed over a first heated surface 18 and then over a second heated surface 19.

As the result of the tissue paper web 5 being formed between the three-dimensionally structured mesh 4 and the forming mesh 3 and as the result of the tissue paper web 5 being dewatered between the three-dimensionally structured mesh 4 and the press felt 9, the contact area between the two heated surfaces 18 and 19 amounts often to nearly 100% of the total area of the side of the tissue paper web 15 facing the heated surfaces 18 and 19.

The first heated surface 18 is formed in this case by the circumferential surface 18 of a first steam-heated drying cylinder 20 and the second heated surface 19 by the circumferential surface 19 of a second steam-heated drying cylinder 21, whereby both circumferential surfaces 18 and 19 are enwrapped for the bigger part by the structured mesh 4. In this case each of the two drying cylinders has a diameter of around 1.8 m. To prevent the tissue paper web 5 from sticking to the two circumferential surfaces 18 and 19, said surfaces are coated advantageously with tungsten carbide and/or with Teflon.

Arranged in the wrap zone above the first drying cylinder 20 is a steam blower box 22 through which steam of approximately 8 bar is directed through the structured mesh 4 onto the tissue paper web 5.

Figure 9:
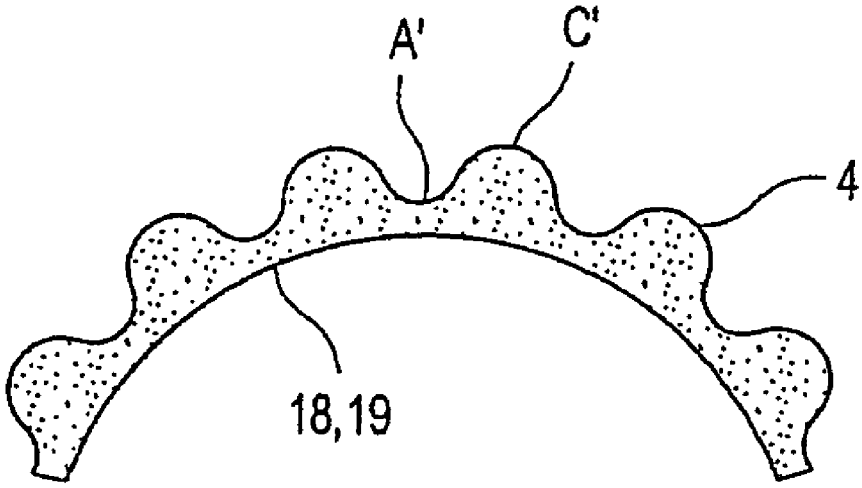
FIG. 9 shows the structure of a tissue paper web upon its drying with the method according to the invention performed with the apparatus in FIG. 1.

As the result of the tissue paper web 5 having been formed between the structured mesh 4 and the relatively smooth forming mesh 3, only the side of the tissue paper web 5 formed on the structured mesh 4 has a corrugated surface whereas the surface formed on the smooth forming mesh 3 is relatively smooth in comparison. During the drying step the tissue paper web 5 thus comes with a large area into contact with the two circumferential surfaces 18 and 19 of the drying cylinders 20 and 21, as the result of which a high dry content of around 39% or more can be obtained (FIG. 9).

Figure 10:
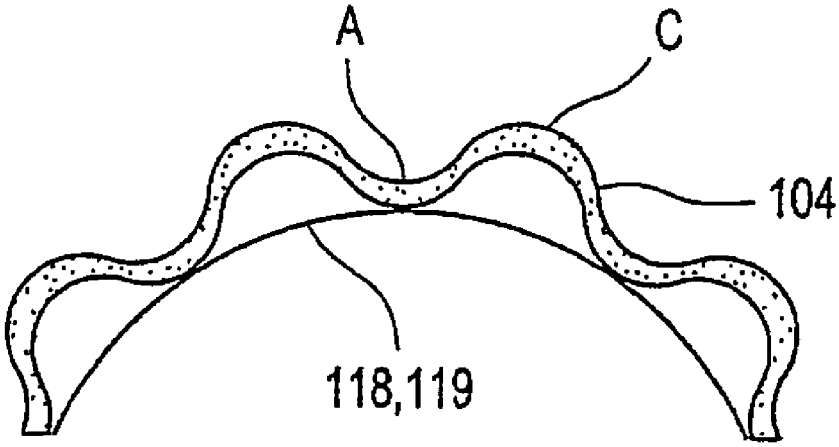
FIG. 10 shows the structure of a tissue paper web upon its drying with a known method according to the prior art.

With the drying step a comparatively far lower dry content can be achieved in the structured tissue paper web 105 resulting from FIG. 8, as the tissue paper web 105 obtained by the structuring step described in FIG. 8 has a corrugated surface on both sides and hence only a small area of contact with the corresponding circumferential surfaces 118, 119 of the drying cylinders (FIG. 10).

After the above described drying step the tissue paper web 5 together with the structured mesh 4 is conveyed in a further dewatering step through a press nip 24, whereby the tissue paper web 5 in the press nip 24 is arranged between the structured mesh 4 and a smooth roller surface 25 of a Yankee drying cylinder 26. Here the press nip 24 is a press nip formed by the Yankee drying cylinder 26 and a shoe press 27.

On the side formed on the flat forming mesh 3 the tissue paper web 5 lies with a relatively large area on the circumferential surface 25 of the Yankee drying cylinder 26, while on the other side the tissue paper web 5 lies on the structured mesh 4.

Figure 11:
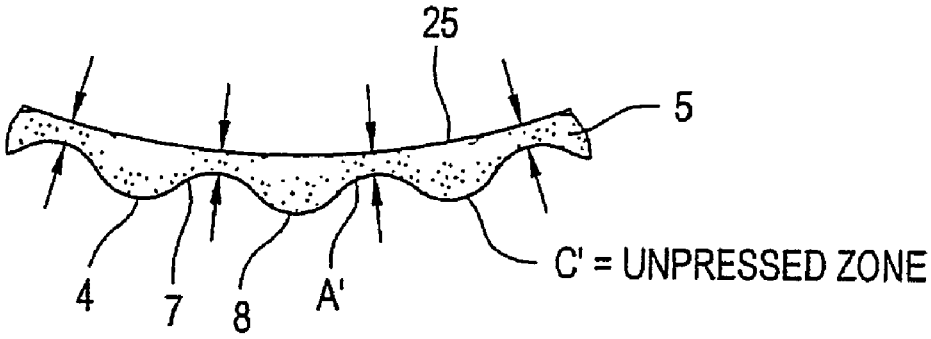
PRIOR ART Fig.11
FIG. 11 shows the structure of a tissue paper web upon its dewatering in the press nip with the method according to the invention performed with the apparatus in FIG. 1.

Here the depressed regions 7 and by comparison relatively raised regions 8 of the structured mesh 4 are constructed and arranged in relation to each other such that the pillow areas C' are essentially not pressed in the press nip 24, said areas being 65% or less, in particular 75% or less of the tissue paper web 5. By contrast, the areas A' are pressed, as the result of which the strength of the tissue paper web 5 is increased (FIG. 11).

Figure 12:
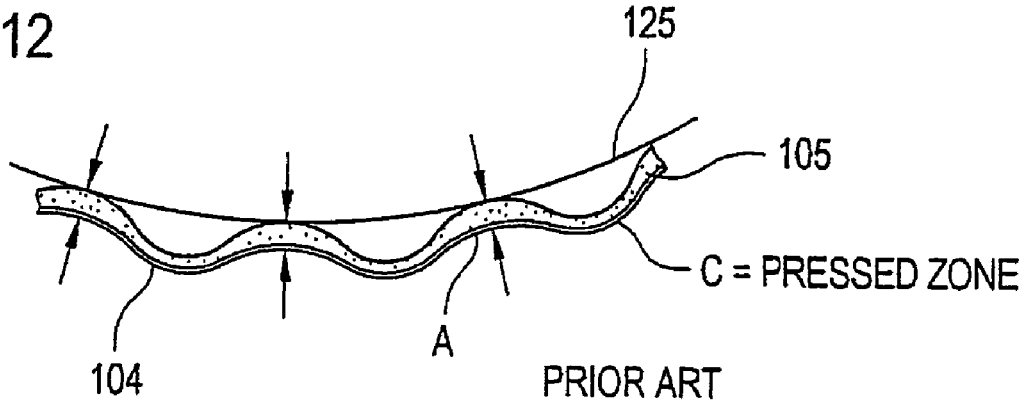
FIG. 12 shows the structure of a tissue paper web upon its dewatering in the press nip with a method known from the prior art.

The tissue paper web 105 known from the prior art comes to rest on the circumferential face 125 of the Yankee drying cylinder with a relatively small area—approximately 25% of the area of the tissue paper web 105—compared to the tissue paper web 5. The disadvantage of this is that the tissue paper 105 might burn on the circumferential face, which is why the temperature of the Yankee cylinder has to be kept lower in the method known from the prior art. Consequently, a lower dry content is obtainable with the method known from the prior art (FIG. 12).

In the case of the tissue paper web 5 produced with the method according to the invention, the area of contact between the circumferential surface 25 of the Yankee drying cylinder 26 and the tissue paper web 5 facing this side amounts to 90% or more, often nearly 100%, of the total area of this side of the tissue paper web 5.

Before the tissue paper web 5 runs through the press nip 24, said tissue paper web is conveyed together with the structured mesh 4 around an evacuated deflector roller 23, whereby the structured mesh 4 is arranged between the tissue paper web 5 and the evacuated deflector roller 23.

Downstream from the press nip 24 the tissue paper web 5 is conveyed over the heated circumferential surface 25 of the Yankee drying cylinder 26 and then taken off said cylinder with a crêpe doctor (illustrated only in FIG. 3). To increase the drying performance a drying hood 28 can be arranged in addition above the Yankee drying cylinder 26 such that the tissue paper web 5 is conveyed between the drying hood 28 and the circumferential surface 25 of the Yankee drying cylinder 26.

From FIG. 2 it is evident that the gas flow can be generated in addition by an overpressure hood 29 arranged above the structured mesh 4, whereby in this case the dewatering step is performed without mechanical pressing force, i.e. unlike in FIG. 1 no provision is made for a press belt 14 which wraps around the roller 12 in some areas.

Unlike the apparatuses according to FIG. 1 or 2, with the apparatus in FIG. 3 the tissue paper web 5 is not formed between a structured mesh and a forming mesh but between two smooth forming meshes 3 and 30. The other process steps which can be performed with the apparatus in FIG. 3 in order to dewater and to dry the tissue paper web 5 correspond essentially to those in FIG. 1.

After the formation of the tissue paper web 5 the latter is transferred with the help of a vacuum device 31 from the forming mesh 30 onto a three-dimensionally structured mesh 32.

In a dewatering step after the formation of the tissue web 5 the tissue paper web 5 is conveyed between the structured mesh 30, which is arranged above, and the press felt 9, whereby during the dewatering step along the dewatering section pressure is exerted on the structured mesh 30, the tissue paper web 5 and the press felt 9 such that the tissue paper web 5 is dewatered in the direction of the press felt 9.

The pressure for dewatering the tissue paper web 5 is generated during the dewatering step at least in some areas simultaneously by a gas flow and a mechanical pressing force.

The mechanical pressing force is generated in this case by the tensioned press belt 14.

After the dewatering step the tissue paper web 5 is subjected to the drying step during which said web, held by the structured mesh 30, is conveyed over the first heated surface 18 and then over the second heated surface 19.

After the above described drying step the tissue paper web 5 together with the structured mesh 30 is conveyed in the further dewatering step through the press nip 24, whereby the tissue paper web 5 in the press nip 24 is arranged between the structured mesh 30 and the smooth roller surface 25 of the Yankee drying cylinder 26. Here the press nip 24 is a press nip formed by the Yankee drying cylinder 26 and the shoe press 27.

For further drying, the tissue paper web 5 is conveyed on the circumferential surface 25 of the Yankee drying cylinder 26 and then taken off said cylinder with a crêpe doctor 33.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for the production of a three-dimensionally structured tissue paper web, comprising the sequential steps of:

pressing the tissue paper web by a mechanical pressing force on one face thereof, in order for it to be structured, on a three-dimensionally structured mesh only on said one face with the other face being substantially smooth;

conveying said tissue paper web, held only by the structured mesh, in a first drying step over at least one heated surface;

conveying the tissue paper web, unheld by a skin, in a second drying step over at least one heated surface, and wherein the tissue paper web is conveyed in a dewatering step prior to the second drying step between an upper 3-dimensionally structured, and permeable skin and a lower permeable skin, whereby pressure is exerted on the upper skin, the tissue paper web and the lower skin during the dewatering step along a dewatering section.

2. A method according to claim 1, wherein the heated surface in the second drying step is formed by the circumferential surface of a Yankee drying cylinder.

3. A method according to claim 1, wherein the heated surface in the second drying step is formed by the circumferential surface of a drying cylinder.

4. A method according to claim 3, wherein the drying cylinder has a diameter of 2 meters or less.

5. A method according to claim 4, wherein the drying cylinder is heated by steam.

6. A method according to claim 5, wherein a steam blower box is arranged in the wrap zone above the drying cylinder.

7. A method according to claim 1, wherein in the second drying step provision is made for several heated surfaces, each formed by the circumferential surface of a drying cylinder which is enwrapped for the bigger part by a permeable skin.

8. A method according to claim 1, wherein with the method some areas of the tissue paper web are more intensively compressed than other areas of the tissue paper web.

9. A method according to claim 8, wherein the tissue paper web is conveyed together with the structured skin around an evacuated deflector roller, whereby the structured skin is arranged between the tissue paper web and the evacuated deflector roller.

10. A method according to claim 1, wherein after the second drying step the tissue paper web has a dry content of 34% or more.

11. A method according to claim 1, wherein after the second drying step the tissue paper web has a dry content of 38% or more.

12. A method according to claim 11, wherein the side of the structured mesh facing the tissue paper web comprises depressed regions and raised regions relative to the depressed regions.

13. A method according to claim 12, wherein the tissue paper web is formed in the depressed and raised regions of the structured mesh.

14. A method according to claim 1, wherein the tissue paper web is formed from a pulp suspension on a 3-dimensionally structured mesh.

15. A method according to claim 14, wherein the structured mesh is a TAD (Through Air Dried) mesh.

16. A method according to claim 1, wherein the side of the structured skin facing the tissue paper web comprises depressed regions and raised regions relative to the depressed regions.

17. A method according to claim 16, wherein the tissue paper web is compressed less intensively in the depressed regions than in the raised regions.

18. A method according to claim 1, wherein the upper structured and permeable skin is a structured mesh, in particular a TAD (Through Air Dried) mesh, and the lower permeable skin is a press felt.

19. A method according to claim 1, wherein the structured mesh for the formation of the tissue paper is the same mesh as in the dewatering step.

20. A method according to claim 1, wherein the structured mesh in the dewatering step is the same mesh as in the second drying step.

21. A method according to claim 1, wherein the compressibility of the upper skin is less than that of the lower skin.

22. A method according to claim 21, wherein the dynamic rigidity (K)—as a measure for the compressibility of the upper skin—is 3000 N/mm or more.

23. A method according to claim 22, wherein the dynamic rigidity (K)—as a measure for the compressibility of the lower skin—is 100000 N/mm or less.

24. A method according to claim 22, wherein the dynamic rigidity (K)—as a measure for the compressibility of the lower skin—is 90000 N/mm or less.

25. A method according to claim 22, wherein the dynamic rigidity (K)—as a measure for the compressibility of the lower skin—is 70000 N/mm or less.

26. A method according to claim 1, wherein the G modulus—as a measure for the elasticity of the lower skin—is 2 $N/mm^2$ or more.

27. A method according to claim 1, wherein the G modulus—as a measure for the elasticity of the lower skin—is 4 $N/mm^2$ or more.

28. A method according to claim 1, wherein the permeability of the lower skin is 80 cfm (cubic feet per minute) or less.

29. A method according to claim 1, wherein the permeability of the lower skin is 40 cfm (cubic feet per minute) or less.

30. Method according to claim 1, wherein the permeability of the lower skin is 25 cfm (cubic feet per minute) or less.

31. A method according to claim 1, wherein in the dewatering step first the upper skin is charged with gas, then the tissue paper web and finally the lower skin.

32. A method according to claim 31, wherein the gas flow through the tissue paper web amounts to approximately 150 $m^3$ per minute per meter length along the dewatering section.

33. A method according to claim 31, wherein the gas flow is generated by a pressure hood arranged above the upper skin.

34. A method according to claim 1, wherein the arrangement of upper skin, tissue paper web and lower skin is conveyed during the dewatering step at least in some areas along the dewatering section between a tensioned press belt and a smooth surface, whereby the press belt acts on the upper skin and the lower skin rests on the smooth surface.

35. A method according to claim 34, wherein the press belt is under a tension of at least 30 kN/m.

36. A method according to claim 34, wherein the press belt is under a tension of at least 60 kN/m.

37. A method according to claim 34, wherein the press belt is under a tension of at least 80 kN/m.

38. A method according to claim 34, wherein the press belt has an open area of at least 25% and a contact area of at least 10% of its total area facing the upper skin.

39. A method according to claim 38, the press belt has an open area of between 75% and 85% and a contact area of between 15% and 25% of its total area facing the upper skin.

40. A method according to claim 38, wherein the press belt has an open area of between 68% and 76% and a contact area of between 24% and 32% of its total area facing the upper skin.

41. A method according to claim 38, wherein the press belt has an open area of between 51% and 62% and a contact area of between 38% and 49% of its total area facing the upper skin.

42. A method according to claim 38, wherein the press belt has an open area of 50% or more and a contact area of 50% or more of its total area facing the upper skin.

43. A method according to claim 34, wherein the smooth surface is formed by the circumferential surface of a roller.

44. A method according to claim 43, wherein the gas flow is generated by a suction zone in the roller.

45. A method according to claim 44, wherein the suction zone has a length in the region of between 200 mm and 2500 mm.

46. A method according to claim 44, wherein the suction zone has a length in the region of between 800 mm and 1800 mm.

47. A method according to claim 44, wherein the suction zone has a length in the region of between 1200 mm and 1600 mm.

48. A method according to claim 44, wherein the vacuum in the suction zone amounts to between −0.2 bar and −0.8 bar.

49. A method according to claim 44, wherein the vacuum in the suction zone amounts to between −0.4 bar and −0.6 bar.

50. A method according to claim 1, wherein the arrangement of upper skin, tissue paper web and lower skin is charged with the gas flow at least in some areas in the region of the dewatering section.

51. A method according to claim 1, wherein the tissue paper web leaves the dewatering section with a dry content of around 30%.

52. A method according to claim 1, wherein after the first drying step and prior to the second drying step the tissue paper web is conveyed together with the skin of the first drying step through a press nip.

53. A method according to claim 52, wherein the tissue paper web in the press nip is arranged between the structured and permeable skin and in particular a smooth roller surface.

54. A method according to claim 52, wherein the depressed and by comparison relatively raised areas of the structured and permeable skin are constructed and arranged in relation to each other such that only 35% or less is pressed in the press nip.

55. A method according to claim 52, wherein the depressed and by comparison relatively raised areas of the structured and permeable skin are constructed and arranged in relation to each other such that only 25% or less of the tissue paper web is pressed in the press nip.

56. A method according to claim 52, wherein the press nip is a shoe press nip.

57. A method according to claim 52, wherein the roller surface is formed by the circumferential surface of a Yankee drying cylinder.

* * * * *